United States Patent [19]

Manderson

[11] Patent Number: 4,557,039

[45] Date of Patent: Dec. 10, 1985

[54] METHOD OF MANUFACTURING TRANSFORMER CORES

[75] Inventor: Laurence Manderson, Sherwood, Australia

[73] Assignee: Susan V. Manderson, Australia

[21] Appl. No.: 400,000

[22] Filed: Jul. 20, 1982

Related U.S. Application Data

[63] Continuation-in-part of Ser. No. 86,321, Oct. 19, 1979, abandoned.

[51] Int. Cl.[4] ..... H01F 41/00

[52] U.S. Cl. ..... 29/605; 29/606; 29/609; 336/212; 336/215; 336/234

[58] Field of Search ..... 336/212, 215, 211, 213, 336/219, 234; 29/605, 606, 609

[56] References Cited

U.S. PATENT DOCUMENTS 2,579,578 12/1951 Horstman et al. ..... 336/215

FOREIGN PATENT DOCUMENTS 593043 2/1960 Canada ..... 336/215
642810 6/1962 Canada ..... 336/212
715946 9/1954 United Kingdom ..... 336/215

*Primary Examiner*—Carl E. Hall
*Attorney, Agent, or Firm*—Schwartz, Jeffery, Schwaab, Mack, Blumenthal & Evans

[57] ABSTRACT

A method of manufacturing transformer cores of either the continuously wound or cut wound type using electrical steel strip having approximately a linear taper. By selecting a suitable taper, a hexagonal (or higher order) approximation of a circular cross section for the legs of the cores is produced. Two complementary core strips can be cut from a single rectangular stock strip in a scrapless manner. The product produced by the method is also disclosed.

4 Claims, 13 Drawing Figures

METHOD OF MANUFACTURING TRANSFORMER CORES

CROSS REFERENCE TO RELATED APPLICATIONS

This is a continuation-in-part of U.S. application Ser. No. 86,321, filed Oct. 19, 1979, now abandoned.

BACKGROUND OF THE INVENTION

1. Field of the Invention

This invention relates to transformer cores of the wound core type which are suitable for either single phase or three phase transformers, and the method of manufacturing same.

2. Description of the Prior Art

There are a multitude of existing transformer designs, which can be broadly categorized as rectangular or cruciform. After examination of these existing types, it was considered that the cruciform types were philosophically superior, but the rectangular types embodied production advantages, including simplicity.

BRIEF SUMMARY OF THE INVENTION

The object of the present invention is to improve upon these existing cores, and the method of manufacturing same.

It is a preferred object to be able to produce a cruciform-like circular core cross section.

It is a further preferred object to produce the cores without a large number of different widths of electrical steel strip being required.

A preferred feature of the present invention is the use of tapered electrical steel strip to produce a hexagonal or better approximation to circular cross section for those portions of the core under the windings to enable the production of cores of near optimum geometry as a straightforward procedure.

Other objects of the present invention will become apparent from the following description.

In the broad aspect, the present invention resides in a method of manufacturing a transformer core from electrical steel strip including the step of:

cutting at least a portion of the strip with non-parallel sides.

Preferably, the portion of the strip is cut with an approximately linear taper.

In another aspect, the present invention resides in a transformer construction using the method.

The invention, in its preferred simplest form, is the hexagonal form approximation of a circular cross section core. This can be achieved in either of two ways, both of which use a single width size of conventionally slit steel strip, which is then specially slit. For scrapless production of cores two identical cores can be slit from a normal parallel sided strip in such a manner that the tapered pieces are complementary to each other. Two identical tapered strips can readily be cut from a suitable rectangular piece by cutting it at an appropriate angle.

BRIEF DESCRIPTION OF THE DRAWINGS

To enable the invention to be fully understood, a number of preferred embodiments will now be described with reference to the accompanying drawings, in which.

DETAILED DESCRIPTION OF THE PREFERRED EMBODIMENTS

The production of the tapered electrical steel strip is implemented by a suitable slitting machine. Because the angle of taper is so small, e.g. less than 1°, the axis of the slitting rollers is set perpendicular to the strip of electrical steel, and the necessary taper is achieved by forcing the rollers across the sheet. The need for precise control of the positioning of the slitting rollers means that the slitting machine is best built with a single pair of rollers for the slitting operation. This means that it only has to accommodate the width of steel needed for the largest core to be cut by the method. The details of the method are most easily illustrated by a description of the relevant parts of the machine. After dereeling, the strip is passed through a pair of plain rollers, comprising a driven roller to control the speed of the strip, and its idler. The strip then passes through two guides with tungsten carbide wear parts which control its lateral position, and then through a second pair of rollers similar to the first. The second idler is identical to the first, but the other roller is machined to have a circumference which matches the number of pulses per revolution of the pulse generator (shaft encoder) that it drives. This unit thus measures the length along the strip as it is fed through, and the slitting roller assembly is immediately adjacent to it. The slitting rollers are mounted on a very rigid frame, and can be set so that they are pre-loaded to minimize deflection and with the desired amount of overlap. The roller frame is wider than the strip, since it must be able to move back and forth across the strip. The frame is mounted on a machine bed and driven by a worm drive from a direct current motor geared down by a large amount because of the slow travel required. Included in this assembly is a second shaft encoder with its own small roller which enables the position of the slitting rollers to be known and controlled. The control system for the slitting roller assembly is straightforward in that the motion of the slitting rollers sideways across the strip is directly proportional to the length of strip passing through. This can be implemented by ordinary logic and servosystem components, but is better and simpler done by a microprocessor based computer which may control the rest of the machine. Thus the tapered strip required for the core designs can readily be produced.

Figure 1:
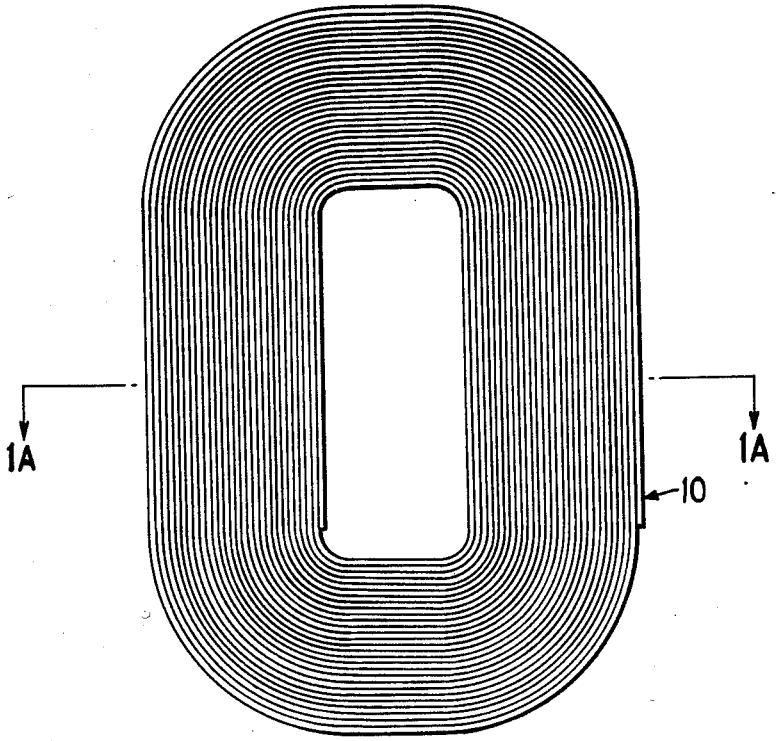
FIG. 1 is a front view of a single phase core of substantially hexagonal cross section.
Figure 1A:
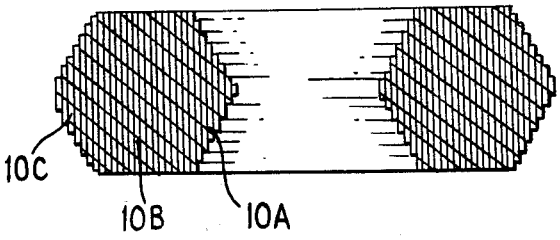
FIG. 1A is a cross-sectional view taken on line 1A—1A of FIG. 1.
Figure 1B:
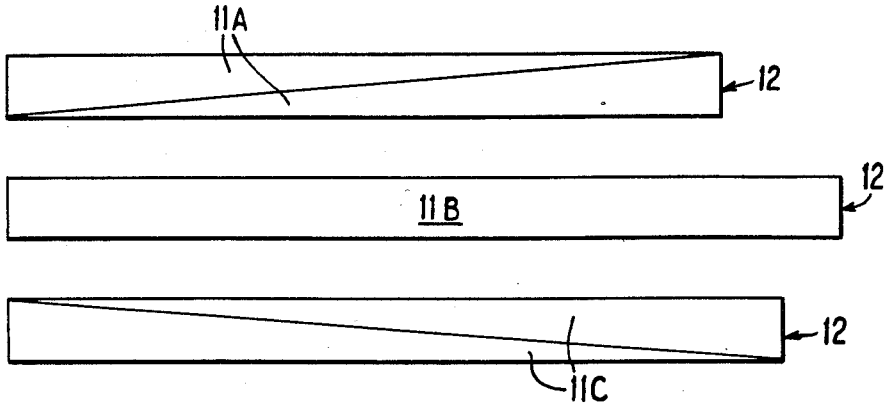
FIG. 1B shows the cutting plan of the strip for the core of FIG. 1.

Referring to FIGS. 1, 1A and 1B, the core 10 which is continuously wound, has a substantially hexagonal cross section as shown in FIG. 1A comprising a section 10A of increasing width, a central section 10B of maximum width, and a section 10C of decreasing width.

Referring to FIG. 1B, section 10A is wound from strip 11A which is cut from a rectangular stock strip 12, the strip 10A having a linear taper from a substantially zero width up to the width of the stock strip 12.

Section 10B is wound from a strip 11B cut from a length of the stock strip 12 and has parallel sides.

Section 10C is wound from a strip 11C from stock strip 12 and has a linear taper from the width of the stock strip 12 down to substantially zero width. As the strip 11A, 11C are of the same width, they can be cut from lengths of stock strip 12.

Figure 2:
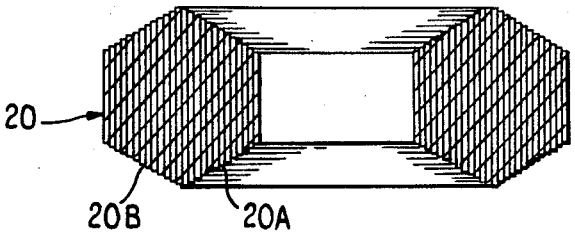
FIG. 2 is a cross-sectional view of a modified form of the core of FIG. 1.
Figure 2A:
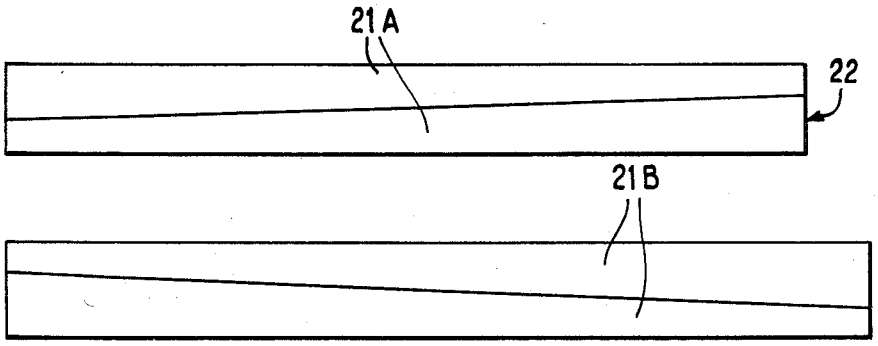
FIG. 2A shows the cutting plan of the strip for the core of FIG. 2.
Figure 3:
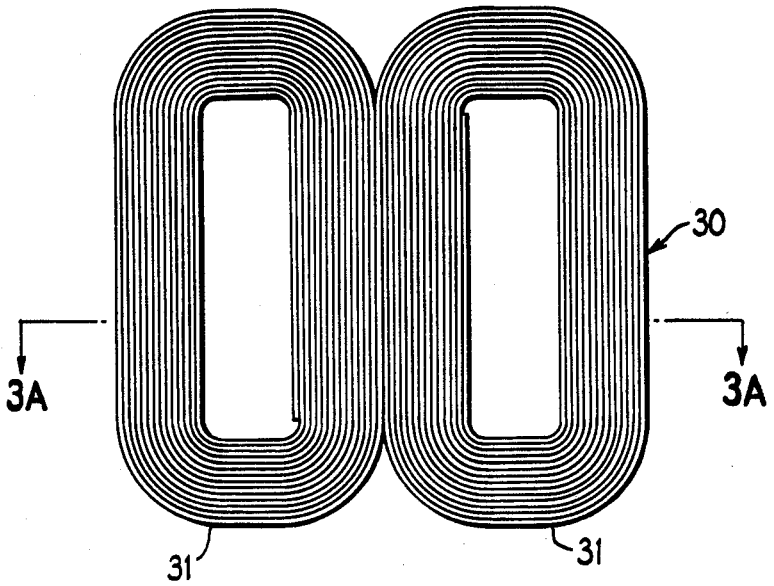
FIG. 3 is a front view of a single phase shell type core.
Figure 3A:
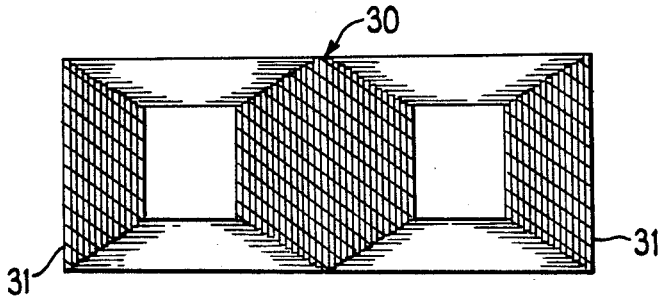
FIG. 3A is a cross-sectional view taken on line 3A—3A of FIG. 3.

In the modified form of the core illustrated in FIGS. 2 and 2A, the core 20 has a section 20A of increasing width and a section 20B of decreasing width. The sections both have a maximum width equal to the maximum width of the core and a minimum width equal to one-half of the core, the sections 20A, 20B being wound from strips 21A, 21B respectively from rectangular stock strip 22 which has a width equal to 1.5 times the maximum width of the core 20. As the strips 21A, 20B are complementary, two transformer cores 20 can be cut from a single length of stock strip 22 without scrap. The single phase shell-type core 30 of FIGS. 3 and 3A has a pair of core frames 31A each with a cross section which is substantially identical with an isosceles trapezium. When the two frames are placed back-to-back, the central leg is substantially hexagonal in cross section (as shown in FIG. 3A). Each frame can be wound from a single strip of increasing width, such as strips 21A, 21B shown in FIG. 2A. As these strips are complementary, the core 30 can be produced from a single piece of rectangular stock strip, i.e. strip 22.

Figure 4:
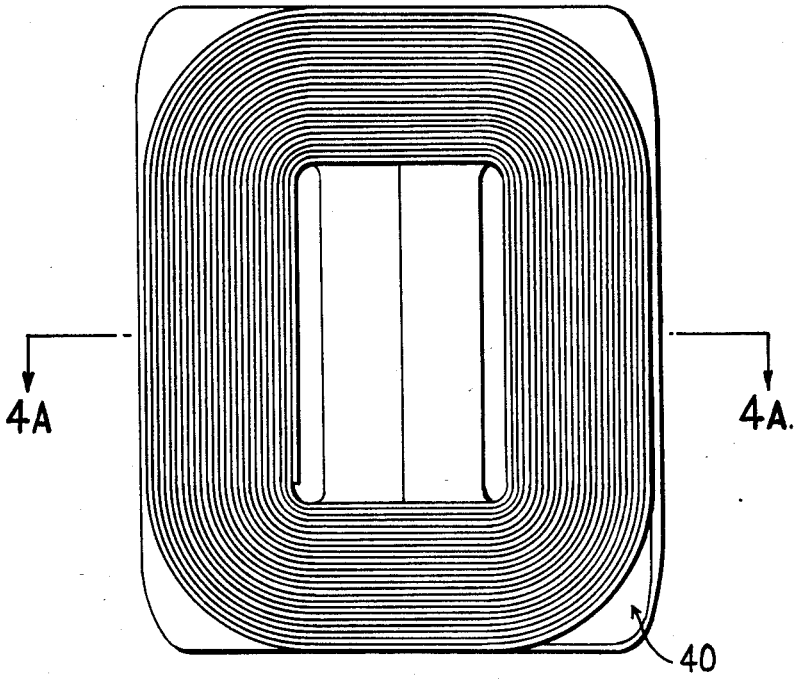
FIG. 4 is a front view of a three phase "delta" core.
Figure 4A:
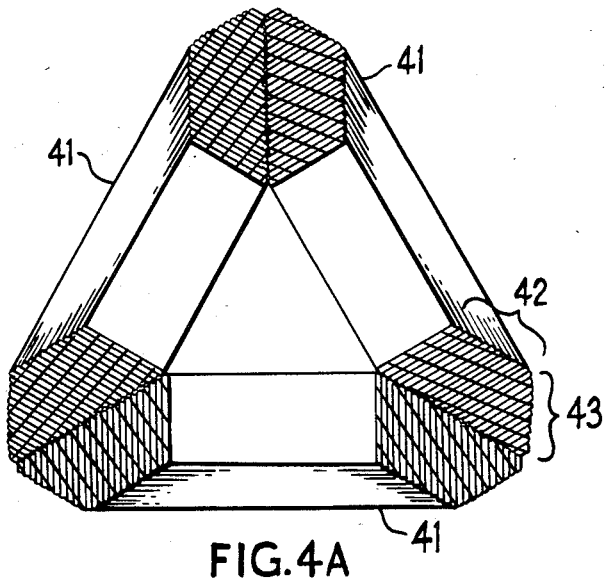
FIG. 4A is a cross-sectional view taken on line 4A—4A of FIG. 4.

The three-phase delta core 40 shown in FIGS. 4 and 4A comprises three frames 41 each conjoined at their sides to the other two frames, the legs of the core having a substantially hexagonal cross section. Each frame 41 is continuously wound from a section 42 of fixed width (equal to 0.5 times the diameter of the leg) cut from a length of rectangular stock strip of that width, and then a section 43 of decreasing width. As the section 43 of two of the frames can be complementary, they can be cut from rectangular stock strip having a width equal to 0.5 times the diameter of the core legs. The core 40 is assembled by placing the frames 41 in the configuration shown in FIGS. 4 and 4A and securing the frames together.

FIGS. 5, 5A, 5B and 5C show a three-phase "star" or "Y" core 50 with legs of substantially hexagonal cross section. The core 50 comprises three frames 51A, 51B, 51C each of substantially C-shape in side view.

Each frame 51A, 51B, 51C is formed from a series of lamination lengths A, B, C respectively cut from a tapered strip 53. The strip 53 is of increasing taper to form section 52A of each frame and of decreasing taper to form section 52B and may be cut as shown in FIG. 2A.

Lamination lengths A, B, C are cut to selected length of square-ended strip 53 with two cuts 53A and 53B at 60° to the longitudinal axis of the strip 53. This cutting step for most size cores can be made ignoring the taper of the layer which comes from the tapered strip 53 because of the small angle of taper.

Figure 5:
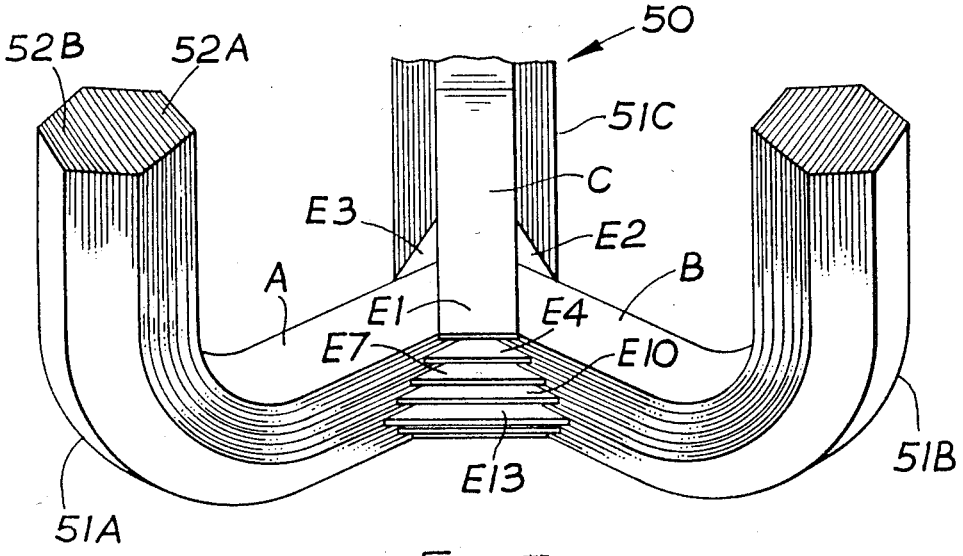
FIG. 5 is a part fragmentary view of the lower portion of a three-phase star core.
Figure 5A:
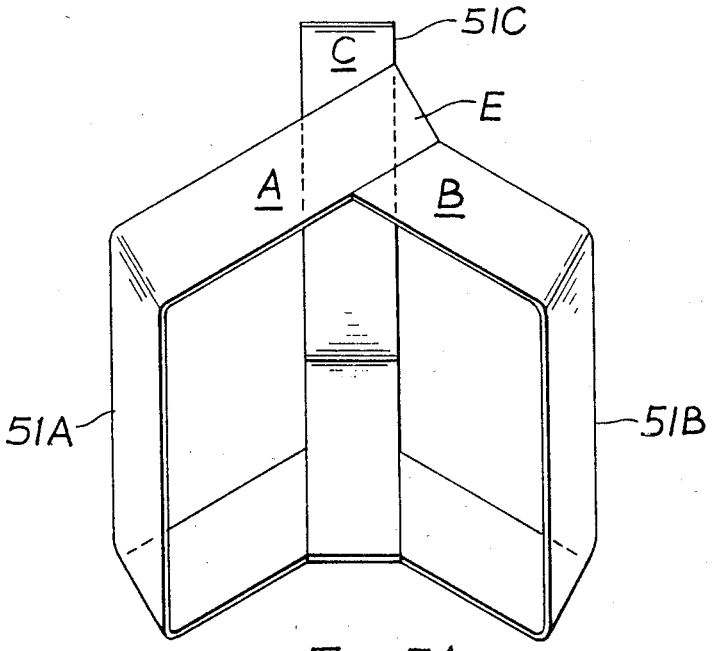
FIG. 5A is a view of an assembled layer of the core of FIG. 5.
Figure 5B:
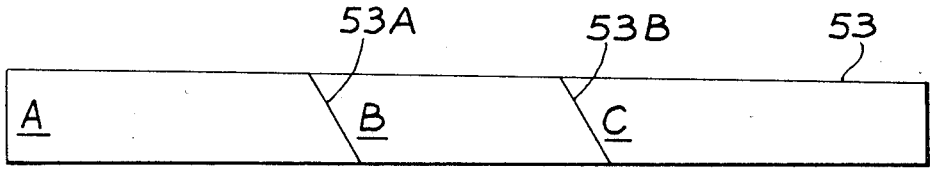
FIG. 5B is a plan view of the strips for the assembled layer of FIG. 5A.

Each layer is formed as shown in FIG. 5A where the angled cut ends and of each lamination length are butted to the side of an adjacent strip adjacent its free ends.

The method of assembling a star core is to lay together all the laminations so that one joint (e.g. the bottom joint shown in FIG. 5) is assembled and the core has the appearance of three radial arms. The joint is clamped and the laminated arms, A, B, C are bent upward until they are perpendicular to the plane of the joint. The arms are secured by clamping and then the joint is unclamped enabling the clamped arms to be separated from the joint. The top portion of each clamped laminated arm is then folded to form a substantially C-shaped laminated assembly of lamination lengths. The electromagnetic properties of the joint are best when each layer is rotated one third of a turn from the previous layer; that is when piece A of FIG. 5A is placed in adjacent core legs in adjacent layers. This core joint is the only straight cut, scrapless, butt interleaved (lapped) star or Y core joint and is applicable not only to cores with tapered strip, but to any core.

Figure 5C:
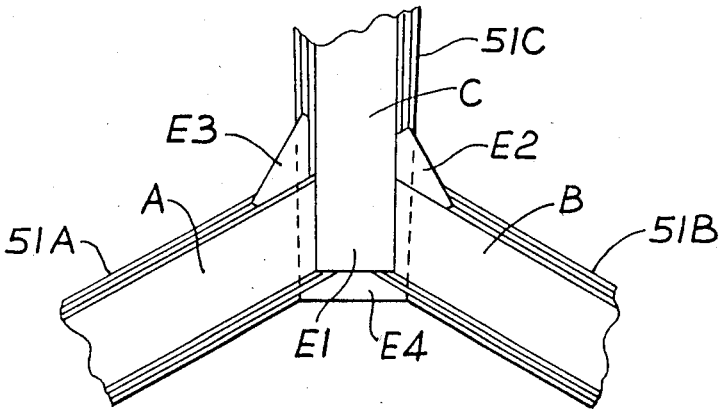
FIG. 5C is a part fragmentary top plan view of the lower joint of the core of FIG. 5.

When the method of the present invention is employed, a generally wedge shaped end section labeled E in FIG. 5 can be seen to protrude from the joint. As shown in FIGS. 5 and 5C, the ends E are labeled in accordance with the layer with which they are associated. For example, E1 is the end section of the joint in the first layer, E2 is the end section of the joint in the second layer and E3 is the end section of the joint in the third layer. It is apparent that end section E1 protrudes from the first joint. After this end section, every third lamination layer has an end section which protrudes in the same direction. These end sections are labeled E4, E7, E10 and E13, respectively. Each of these end sections is larger than the previous end section, with E1 being the smallest and E13 being the largest. FIG. 5C shows that the end sections increase in size in accordance with the width of the lamination. The first lamination is shown in solid lines and forms end section E1. The second lamination forms end section E2 which is rotated by 60° from E1. The third lamination forms end section E3 which is rotated by 60° from end section E2. The fourth lamination is shown in dotted lines where it extends beneath the prior lamination and forms end section E4. In order for end section E4 to accommodate the greater width of the laminations of the fourth layer, it must extend further than end section E1. The end sections discussed are associated with sections 52A of each frame. These end sections increase in width from end section E1 to end section E13. The end sections associated with frame sections 52B decrease in width similarly. Accordingly, the resultant end section profile formed between frames 51A, 51B and 51C is somewhat triangular in configuration.

These end sections serve a useful purpose in assembling the three frames of the core of the present invention. The core is assembled by interleaving the individual laminations of each core frame. Due to the wedge shaped end sections on each frame, the lamination layers of the core frames will interleave progressively as they are pushed together to form the core. This makes assembly and disassembly of the core of the present invention relatively uncomplicated. Accordingly, with the core of the present invention it is possible to separate the three legs of the core in order to fit windings therearound, and then to reassemble the core in a very uncomplicated manner.

The use of tapered strips 53 to produce the laminations of the core of the present invention results in a very effective way of producing either hexagonal or higher order arrangements. However, the length of the laminations in successive layers proceeding from the first layer shown in FIG. 5 to the 13th layer increases in a non-linear progression, since superimposed on the radial buildup of the core is a change in length associated with the change in width of the individual layers. Naturally, from the 13th layer to the last layer, the individual layers increase in length in accordance with the same non-arithmetic progression.

The method of calculating the length is based on making an initial estimate of the required total length. Then, by using the appropriate taper for the estimated length, the dimensions of each piece can be readily calculated. The error in the initial estimate then provides a correction factor and the calculation is repeated until the exact degree of accuracy required is obtained. This method can be carried out by use of a computer program in accordance with the following equations:

Equations:

$$n = \text{INTEGER}\left[\frac{3\,CLD}{2 * THK} + 0.5\right]$$

$$STR = HT + \frac{2}{\sqrt{3}}\,WID - \frac{\sqrt{3}}{2}\,CLD - (4 - \pi)\,MBR$$

$$\text{Length} = 3n\,STR + \frac{3\pi}{2}\,n^2\,THK - 0.491\,n\,CLD$$

$$\text{note } 0.491 = \tfrac{3}{4}\left(\frac{2}{\sqrt{3}} - 0.5\right)$$

$$\text{Volume} = \tfrac{3}{8}\,CLD * THK * \text{Length}$$

$$\text{Mass} = 0.97 * 7.65 \times 10^{-6} * \text{Volume}$$
$$= 7.42 * 10^{-6} * \text{Volume}$$

$$\text{Note Gross } CSA = \frac{3\sqrt{3}\,R^2}{2} = \frac{3\sqrt{3}}{8}\,CLD^2$$

Where:

THK = thickness of the electrical steel.

CLD = core leg diameter, the maximum width of the core.

HT = height of the winding window.

WID = leg centers (winding diameter)

STR = center line string length equivalent to first laminations

MBR = minimum bend radius of core steel n = number of layers of laminations in the core.

All of the new core designs, being of the wound core type, require annealing after they have been cut and formed to shape.

By using the tapered strip to form the cores, which can be continuously wound (except for the star core 50 of FIGS. 5, 5A and 5B), the transformer designer can achieve great flexibility in design. By careful selection of the taper of the electrical strip, he can achieve almost any core cross section which he may require and can almost achieve the theoretically optimum circular cross section. For simplicity, the hexagonal cross section as an approximation of the circular cross section is readily achievable.

The invention, in addition to its application as a means of producing the hexagonal form approximation, can in an analogous fashion to the cruciform case, be used to produce octagonal or higher order even regular sided approximations to a circular cross section. However, for each pair of sides in excess of six an additional size of parallel strip is required to allow scrapless production of the core.

Various changes and modifications may be made to the methods described without departing from the scope of the present invention.

What is claimed is:

1. A method of manufacturing a transformer core from electrical steel strip wherein said core comprises three frames each of substantially C shape in side view, the frames being arranged substantially 120° apart, comprising:

cutting a first strip of increasing constant taper from a minimum width to a maximum width;

cutting a second strip having a decreasing constant taper from a maximum width to a minimum width;

cutting each strip into a plurality of lamination lengths, each group of three lamination lengths being separated from the adjacent group at an end which is cut at substantially 90° to its longitudinal axis, each said group forming a layer of the core, with three lamination lengths in the group being separated from each other by cuts at substantially 60° to the longitudinal axis, the length dimensions of each layer being predetermined as a function of strip width of the layer such that the length dimensions vary in a non-linear manner from layer to layer;

butt joining the ends of two of the lamination lengths cut at substantially 60° to the sides of a third lamination length adjacent an end of the third lamination length cut at substantially 90° to form a lamination layer; and assembling the lamination layers by butt joining the free ends of each lamination layer to form the assembled core such that the cross section of each substantially C-shaped frame is polygonal, and the side elevational profile of the exposed end of each substantially C-shaped frame is substantially wedge-shaped.

2. The method according to claim 1, wherein each of the substantially C-shaped frames is detached from the assembled core for annealing.

3. The method according to claim 1 or 2, wherein the lamination length comprising each successive lamination layer are assembled on adjacent core frames.

4. The method according to claim 1 wherein each of the substantially C-shaped frames is detached from the assembled core for a winding operation.

* * * * *